US005101695A

United States Patent [19]

Johnson

[11] Patent Number: 5,101,695

[45] Date of Patent: Apr. 7, 1992

[54] SOCKET WRENCH

[76] Inventor: Gary Johnson, P.O. Box 6369, Modesto, Calif. 95355

[21] Appl. No.: 671,470

[22] Filed: Mar. 19, 1991

[51] Int. Cl.[5] ..... B25B 13/01

[52] U.S. Cl. ..... 81/124.6; 81/121.1

[58] Field of Search ..... 81/124.6, 121.1, 125, 81/124.5, 125.1

[56] References Cited

U.S. PATENT DOCUMENTS

| | | | |
|---|---|---|---|
| D. 142,054 | 8/1990 | Young | D54/16 |
| 284,076 | 8/1883 | Searles | 81/124.6 |
| 3,908,488 | 9/1975 | Andersen | 81/121 R |
| 3,924,492 | 12/1975 | Bray | 81/124.6 |
| 4,328,720 | 5/1982 | Shiel | 81/124.6 |
| 4,459,716 | 7/1984 | Valadez | 81/121.1 |
| 4,602,534 | 7/1986 | Moetteli | 81/177.85 |
| 4,765,211 | 8/1988 | Colvin | 81/119 |

FOREIGN PATENT DOCUMENTS

| | | | |
|---|---|---|---|
| 0620970 | 4/1949 | United Kingdom | 81/124.6 |

*Primary Examiner*—Bruce M. Kisliuk
*Assistant Examiner*—Lawrence Cruz
*Attorney, Agent, or Firm*—Shlesinger, Arkwright & Garvey

[57] ABSTRACT

A socket wrench comprises a socket head having an opening for slidably receiving a nut and a flange disposed at an opposite end of the opening and extending inwardly into the opening; a pipe having one end secured to the socket head; and a driver receptor secured to the other end of the pipe. The flange includes a central opening that is smaller than the inside diameter of the pipe and that communicates with the interior of the pipe, thereby permitting an end portion of a long bolt to extend into the interior of the pipe when a nut is screwed down along the bolt.

14 Claims, 2 Drawing Sheets

FIG. 1
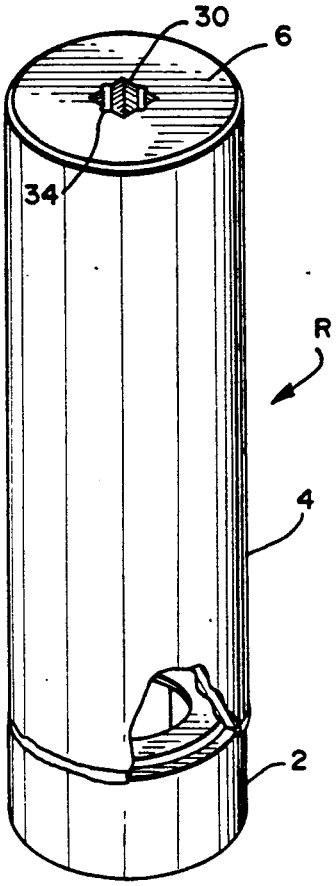
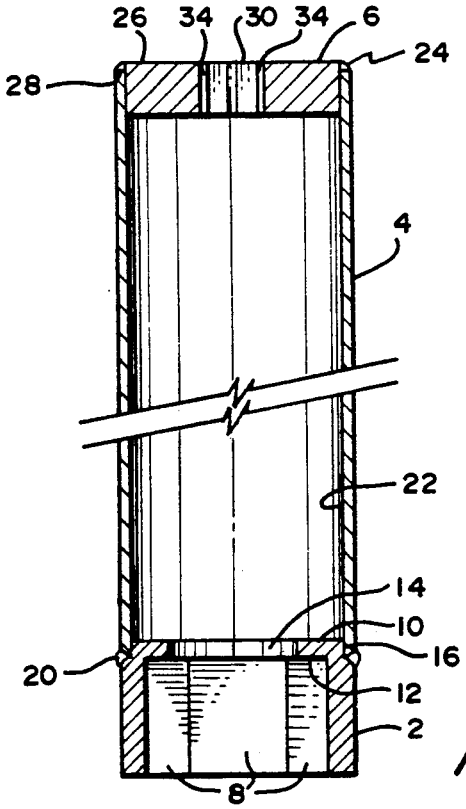
FIG. 2
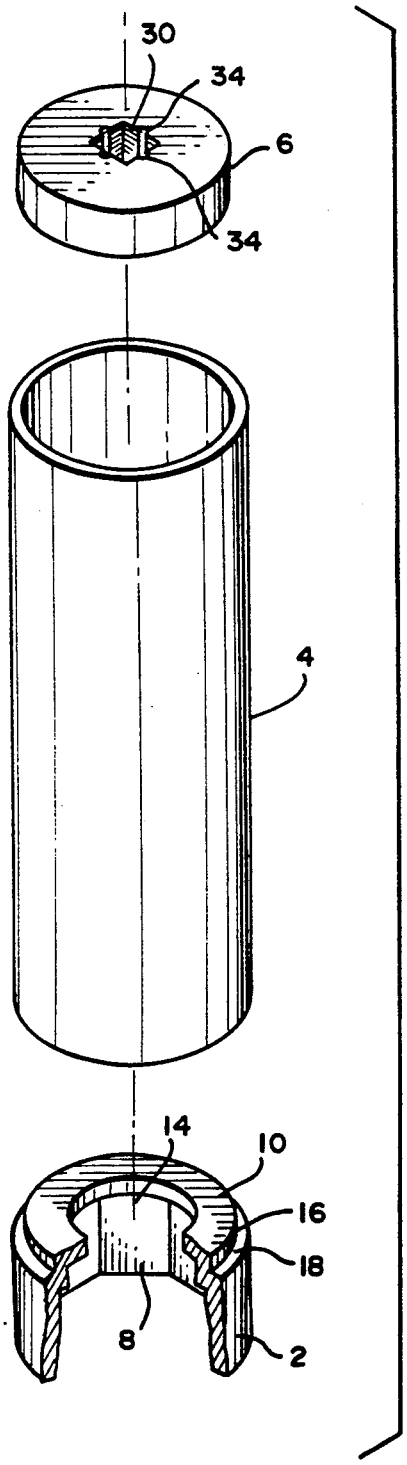
FIG. 3

FIG. 4
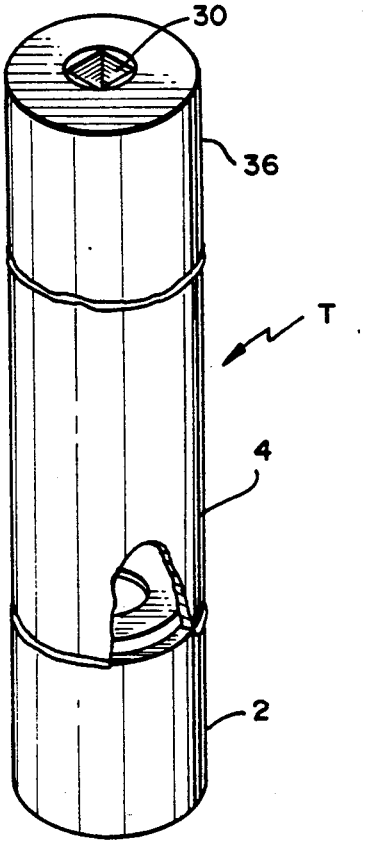
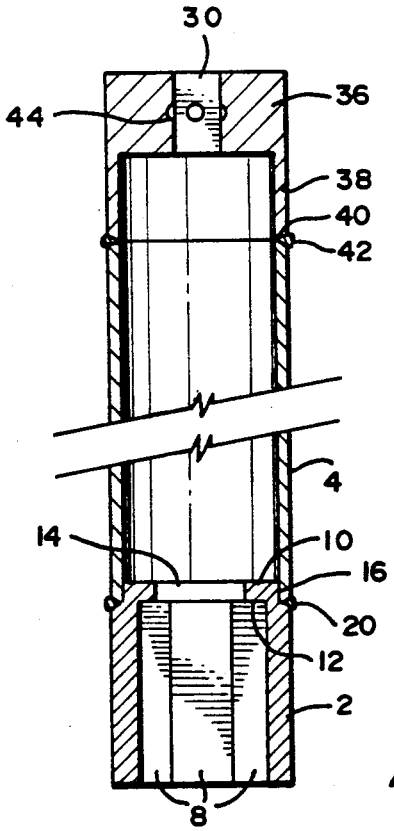
FIG. 5
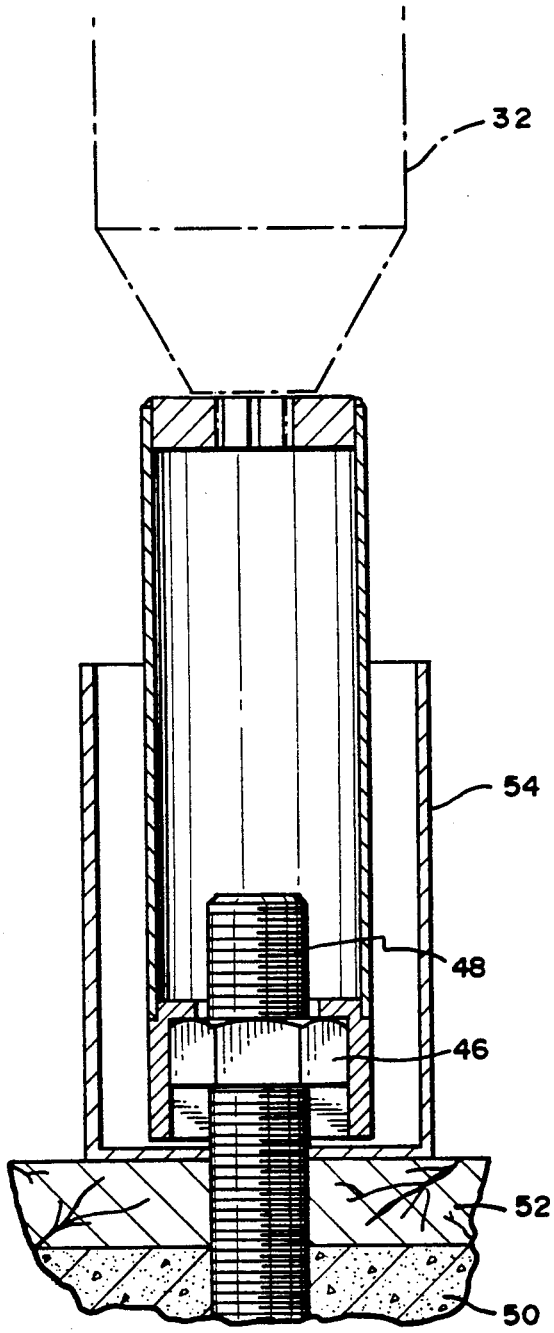
FIG. 6

SOCKET WRENCH

FIELD OF THE INVENTION

The present invention relates generally to a socket wrench and particularly to a deep socket wrench for driving a nut around a long bolt used, for example, as anchor bolt in woodframe house construction.

BACKGROUND OF THE INVENTION

A woodframe house is typically anchored to its concrete or cinderblock foundation by means of anchor bolts that are embedded in the foundation. The bolts extend through sill plates that make up the bottom portion of the woodframe. Nuts are secured to the bolts to clamp the sill plates to the foundation. The anchor bolts typically protrude beyond the sill plates for several inches, making the nut tightening step time-consuming for a handtool, such as open end or box wrench. A regular socket wrench is not normally usable in this situation, since the bolts typically extend well beyond the normal depth of the tool. To compound this situation, it is not unusual for the anchor bolts to be disposed adjacent a stud or an obstruction, thereby making the use of regular wrench even a more difficult task. Furthermore, where tie-down brackets are used, even less room is available for using a box wrench.

The present invention provides a socket wrench that provides a solution to the above mentioned problem.

OBJECTS AND SUMMARY OF THE INVENTION

It is therefore an object of the present invention to provide a socket wrench that can be used for driving nuts around bolts, such as those typically used in woodframe house construction.

It is another object of the present invention to provide a socket wrench that can accommodate long anchor bolts typically used in woodframe house construction.

It is still another object of the present invention to provide a socket wrench that can be used with a power tool to facilitate the tightening of anchor bolts to secure the sill plates of a woodframe of a house, thereby to save time.

It is an object of the present invention to provide a socket wrench that permits tightening of nuts around long bolts in cramped spaces.

It is still an object of the present invention to provide a socket wrench that provides positive indication to the user on how far the nut has progressed relative to the bolt.

It is another object of the present invention to provide a socket wrench that is relatively inexpensive to manufacture.

It is still another object of the present invention to provide a socket wrench that requires minimum number of parts to manufacture.

It is yet another object of the present invention to provide a socket wrench that is relatively simple to make in any length.

In summary, the present invention provides a deep socket wrench that can accommodate the threaded rod of a long bolt within itself when screwing a nut around the bolt.

These and other objects of the present invention will become apparent from the following detailed description.

BRIEF DESCRIPTIONS OF THE DRAWINGS

FIG. 1 is a perspective view of a socket wrench according to the present invention.

FIG. 2 is a longitudinal cross-sectional view of the socket wrench in FIG. 1, shown in indeterminate length.

FIG. 3 is a exploded view of the component parts of the socket wrench in FIG. 1.

FIG. 4 is a perspective view of another embodiment of the socket wrench according to the present invention.

FIG. 5 is a longitudinal cross-sectional view of the socket wrench in FIG. 4, shown in indeterminate length.

FIG. 6 is a cross-sectional view of the socket wrench in FIG. 1 being used to screw the nut of an anchor bolt.

DETAILED DESCRIPTION OF THE INVENTION

An embodiment of the present invention is disclosed as a socket wrench R, as best shown in FIG. 1. The socket wrench R comprises a socket head 2, a tubular pipe extension 4 and a driver receptor 6.

The socket head 2 has planar surfaces 8 that define an enclosed cross-sectional shape, such as a hexagon, as best shown in FIG. 2. The socket head 2 has an annular flange 10 that extends radially inwardly, thereby providing an annular stop surface 12 that is substantially transverse to the planar surfaces 8. A central opening 14, communicating with the interior of the pipe extension 4, is defined by the annular flange 10. An annular recess 16 is disposed in the flange 10 and defines a step 18. The recess 16 has a diameter slightly less than the inside diameter of the pipe extension 4 such that the recess 16 fits within one end of the pipe extension 4, as best shown in FIG. 2. An annular welding bead 18 secures the socket head 2 to one end of the pipe extension 4, as best shown in FIG. 2.

The flange 10 extends substantially transversely to the inner wall 22 of the pipe extension 4, as best shown in FIG. 2.

The pipe extension 4 has substantially uniform thickness and circular cross-section. The other end of the pipe extension 4, disposed away from the socket head 2, is secured to the driver receptor 6 by means of an annular welding bead 24, as shown in FIG. 2.

The driver receptor 6 is a solid cylindrical body having a diameter slightly less than the inside diameter of the pipe extension 4, permitting the driver receptor 6 to be disposed within the pipe extension 4, as best shown in FIG. 2. The driver receptor 6 has a top surface 26 that is slightly above an edge 28 of the pipe extension 4 to permit the welding bead 24 to be substantially triangular in cross-section, as best shown in FIG. 2.

The driver receptor 6 includes a square opening 30 for receiving the cooperating output shaft of a power driver 32, shown in dashed lines in FIG. 6. The square opening 30 has a recess 34 on each of its four sides to permit releasable securement to the power driver 32.

Another embodiment of the present invention is disclosed in FIG. 4 as a socket wrench T, which includes a driver receptor 36 with a wall extension portion 38 that has the same cross-sectional shape as the tubular pipe extension 4. An outer edge 40 of the wall extension 38 butts against the other end of the tubular pipe extension 4 and is secured thereto by means of an annular welding bead 42, as best shown in FIG. 5. Each of the four sides of the square opening 30 has a round recess 44 for cooperating with a ball detent in the output shaft of the power driver 32.

In operation, the tool R is used to drive the nut 46 of an anchor bolt 48 embedded in a concrete foundation 50 and protruding through a sill plate 52 and a tie-down bracket 54. The stop surface 12 formed by the annular flange 10 engages the nut 46 and prevents it from going upwardly when the socket wrench R is pressed down upon it. The central opening 14 advantageously permits the end portion of the bolt 48 to protrude through the pipe extension 4 as the nut 46 moves down toward the bracket 54 and the sill plate 52.

The tool R may be made to any desired length by simply choosing the appropriate length of the pipe extension 4.

It will be appreciated by a person of ordinary skill in the art that socket wrench R may be made relatively inexpensively, since in most cases, only the socket head 2 will need to be cast. The other component parts are obtained from readily available materials.

A person of ordinary skill in the art will appreciate that the socket wrench R will provide a positive feedback to the user when driving the nut 46 around the bolt 48, since the socket wrench R will move down with the nut 46 during use. The stop surface 12 prevents the nut from sliding into the pipe extension 4.

While this invention has been described as having preferred design, it is understood that it is capable of further modification, uses and/or adaptations of the invention following in general the principle of the invention and including such departures from the present disclosure as come within known or customary practice in the art to which the invention pertains, and as may be applied to the essential features set forth, and fall within the scope of the invention or the limits of the appended claims.

I claim:

1. A socket wrench, comprising:
a) a socket head having an opening for slidably receiving a nut and a flange disposed at an opposite end of said opening, said flange extending inwardly into said opening;
b) a pipe having one end secured to said socket head, said pipe having an opening;
c) a driver receptor secured to the other end of said pipe;
d) said flange including a central opening communicating with the interior of said pipe, thereby permitting an end portion of a long bolt to extend into the interior of said pipe when a nut is screwed down along the bolt;
e) said flange opening is smaller than said pipe opening;
f) a first welding bead means for securing said socket head to said one pipe end; and
g) a second welding bead means for securing said driver receptor to said other pipe end.

2. A socket wrench as in claim 1, wherein:
a) said socket head includes an annular shoulder; and
b) said one end of said pipe is operably associated with said shoulder.

3. A socket wrench as in claim 1, wherein:
a) said driver receptor has a central square opening having four sides; and
b) each of said sides has a groove.

4. A socket wrench as in claim 1, wherein:
a) said pipe is cylindrical having an inside diameter;
b) said driver receptor is a cylinder having a diameter less than the diameter of said pipe; and
c) said driver receptor is disposed within said other end of said pipe.

5. A socket wrench as in claim 1, wherein:
a) said driver receptor includes a cylindrical wall extension having a cross-section substantially the same as the cross-section of said pipe; and
b) said cylindrical wall has an edge secured to said other end of said pipe.

6. A socket wrench as in claim 1, wherein:
a) said pipe is substantially long such that said driver receptor and said socket head are substantially spaced apart from each other.

7. A socket wrench as in claim 1, wherein:
a) said pipe has a substantially uniform cross-sectional thickness.

8. A socket wrench as in claim 1, wherein:
a) said pipe extension has an inside wall surface; and
b) said flange extends substantially transversely to said inside wall surface.

9. A socket wrench, comprising:
a) a socket head having an opening for slidably receiving a nut and a flange disposed at an opposite end of said opening and extending inwardly into said opening;
b) a cylindrical pipe having one end secured to said socket head;
c) said pipe being substantially long such that said driver and said socket head are substantially spaced apart from each other;
d) a driver receptor secured to the other end of said pipe;
e) said driver receptor including a central square opening having four sides and each of said sides has a groove;
f) said socket head including an annular shoulder and one end of said pipe is operably associated with said shoulder;
g) said flange including a central opening communicating with the interior of said pipe, thereby permitting an end portion of a long bolt to extend into the interior of said pipe when a nut is screwed around the bolt;
h) first welding bead means for securing said one end of said pipe to said socket head; and
i) second welding bead means for securing said other end of said pipe to said driver receptor.

10. A socket wrench as in claim 9, wherein:
a) said pipe has an inside diameter; and
b) said central opening is smaller than the inside diameter of said pipe.

11. A socket wrench as in claim 10, wherein:
a) said pipe extension has an inside wall surface; and
b) said flange extends substantially transversely to and away from said inside wall surface.

12. A method for making a socket wrench, comprising the steps of:
a) providing a socket head having an outside diameter;
b) providing a pipe extension having a diameter substantially equal to the outside diameter of the socket head;
c) providing a driver receptor;

d) securing one end of the pipe to the socket head and the other end to the driver receptor; and e) welding the one end of the pipe to the socket head and the other end to the driver receptor.

13. A method as in claim 12, and including the step of:

a) cutting the pipe extension to any desired length.

14. A method as in claim 13, and including the step of:

a) providing the socket head with an annular recess having a diameter slightly smaller than the inside diameter of the pipe extension; and b) fitting the one end of the pipe extension to the annular recess.

* * * * *